US006454441B1

(12) United States Patent
Lin

(10) Patent No.: US 6,454,441 B1
(45) Date of Patent: Sep. 24, 2002

(54) DECORATIVE LIGHTING DEVICE FOR FESTIVAL OR THE LIKE

(75) Inventor: Yu Chuan Lin, Chong Ho (TW)

(73) Assignee: Superstar Lighting Co., Ltd., Taipei (TW)

( * ) Notice: Subject to any disclaimer, the term of this patent is extended or adjusted under 35 U.S.C. 154(b) by 0 days.

(21) Appl. No.: 09/826,280

(22) Filed: Apr. 3, 2001

(51) Int. Cl.[7] ..... F22V 33/00

(52) U.S. Cl. ..... 362/294; 362/806; 40/412; 40/441

(58) Field of Search ..... 362/96, 294, 264, 362/373, 806, 808; 40/406, 412, 439, 441, 540, 428

(56) References Cited

U.S. PATENT DOCUMENTS 1,824,388 A * 9/1931 Birch ..... 362/96
6,312,137 B1 * 11/2001 Hsieh ..... 362/96

* cited by examiner

*Primary Examiner*—Sandra O'Shea
*Assistant Examiner*—Bao Truong

(57) ABSTRACT

A lighting device includes a decorative member disposed on a plate, one or more light devices may be used for lighting the decorative member, and a fan device may be used to blow the decorative member and to oscillate or fluctuate the decorative member for generating the other decorative effects. One or more sockets are secured to the plate with brackets for plugging the light devices. The plate includes a housing having one or more air passages formed between the fan device and the decorative member for allowing the air stream to flow toward the decorative member.

1 Claim, 4 Drawing Sheets

DECORATIVE LIGHTING DEVICE FOR FESTIVAL OR THE LIKE

BACKGROUND OF THE INVENTION

1. Field of the Invention

The present invention relates to a lighting device, and more particularly to a lighting device for festival decorative purposes.

2. Description of the Prior Art

Typically, excavated pumpkins or skulls are used for decorative purposes in the Halloween festival or in the All Saints' Day. Some people may put the lights or the candles in the pumpkin heads or in the skulls for lighting purposes. However, it is inconvenient to make such decorative lighting devices.

The present invention has arisen to mitigate and/or obviate the afore-described disadvantages of the conventional lighting devices.

SUMMARY OF THE INVENTION

The primary objective of the present invention is to provide a lighting device for generating specialized lighting effects and for festival decorative purposes.

In accordance with one aspect of the invention, there is provided a lighting device comprising a plate, a decorative member disposed on the plate, means for lighting the decorative member, and means for blowing the decorative member and for oscillating or fluctuating the decorative member for generating different decorative effects.

The plate includes at least one panel provided thereon, and means for securing the decorative member to the at least one panel of the plate.

The lighting means includes at least one light device supported in the plate and directed toward the decorative member for lighting the decorative member.

The plate includes at least one lamp shade provided therein for receiving the at least one light device.

The plate includes a locking channel formed therein, the lighting means includes a bracket having a first end attached to the locking channel of the plate and having a second end, and a socket attached to the second end of the bracket.

The plate includes a housing having at least one air passage formed thereon, and blowing means includes a fan device attached to the housing for generating an air stream to flow through the air passage of the housing and to flow toward the decorative member.

The housing includes at least one partition secured therein for forming the at least one air passage therein.

The plate includes at least one leg extended downward therefrom for forming a chamber therein.

A base is further provided and includes a bowl-shaped receptacle disposed on top thereof, the plate is disposed on top of the receptacle.

The receptacle includes a peripheral portion having a plurality of orifices provided therein for heat dissipating purposes.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
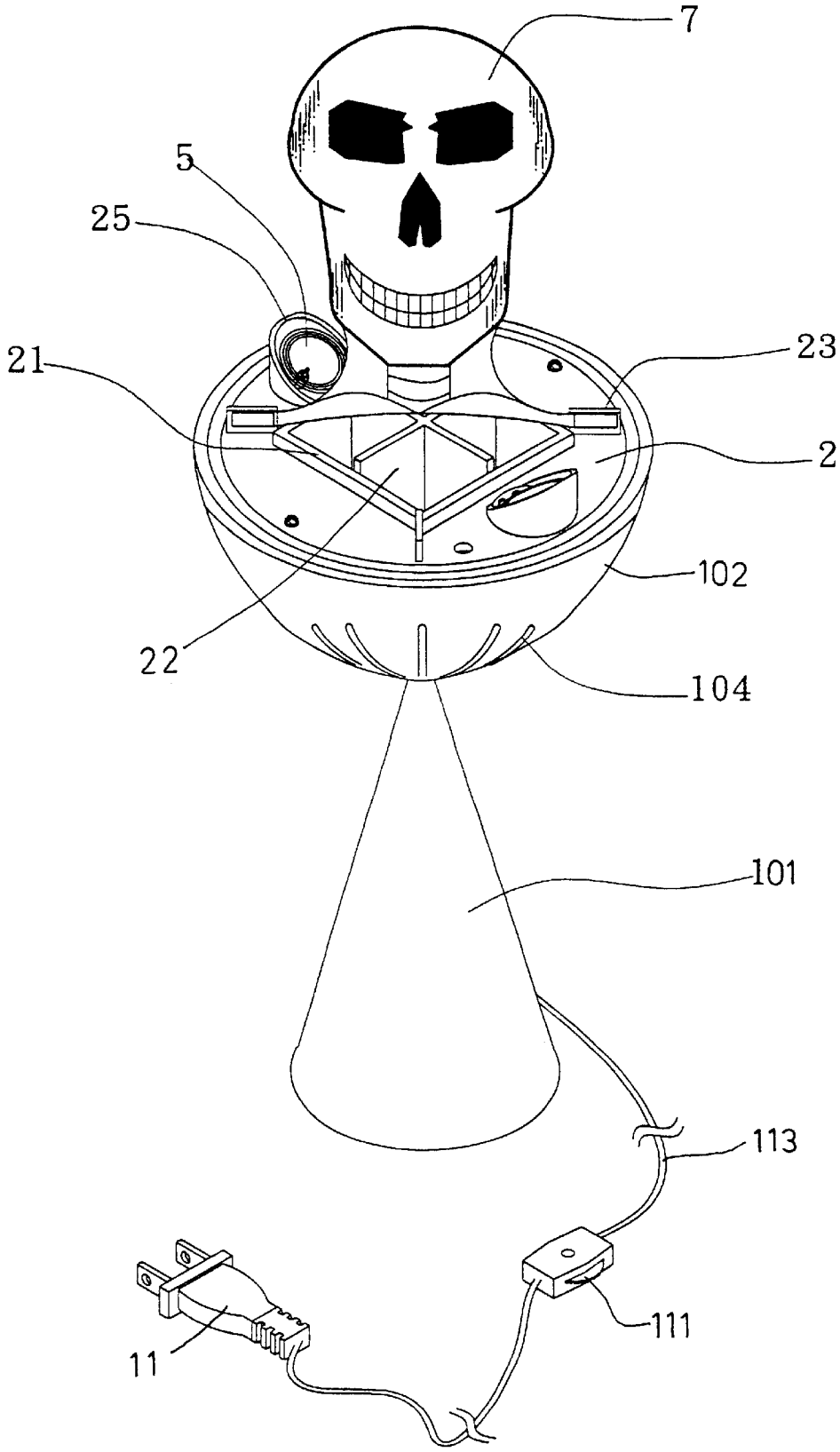
FIG. 1 is a perspective view of a lighting device in accordance with the present invention.
Figure 2:
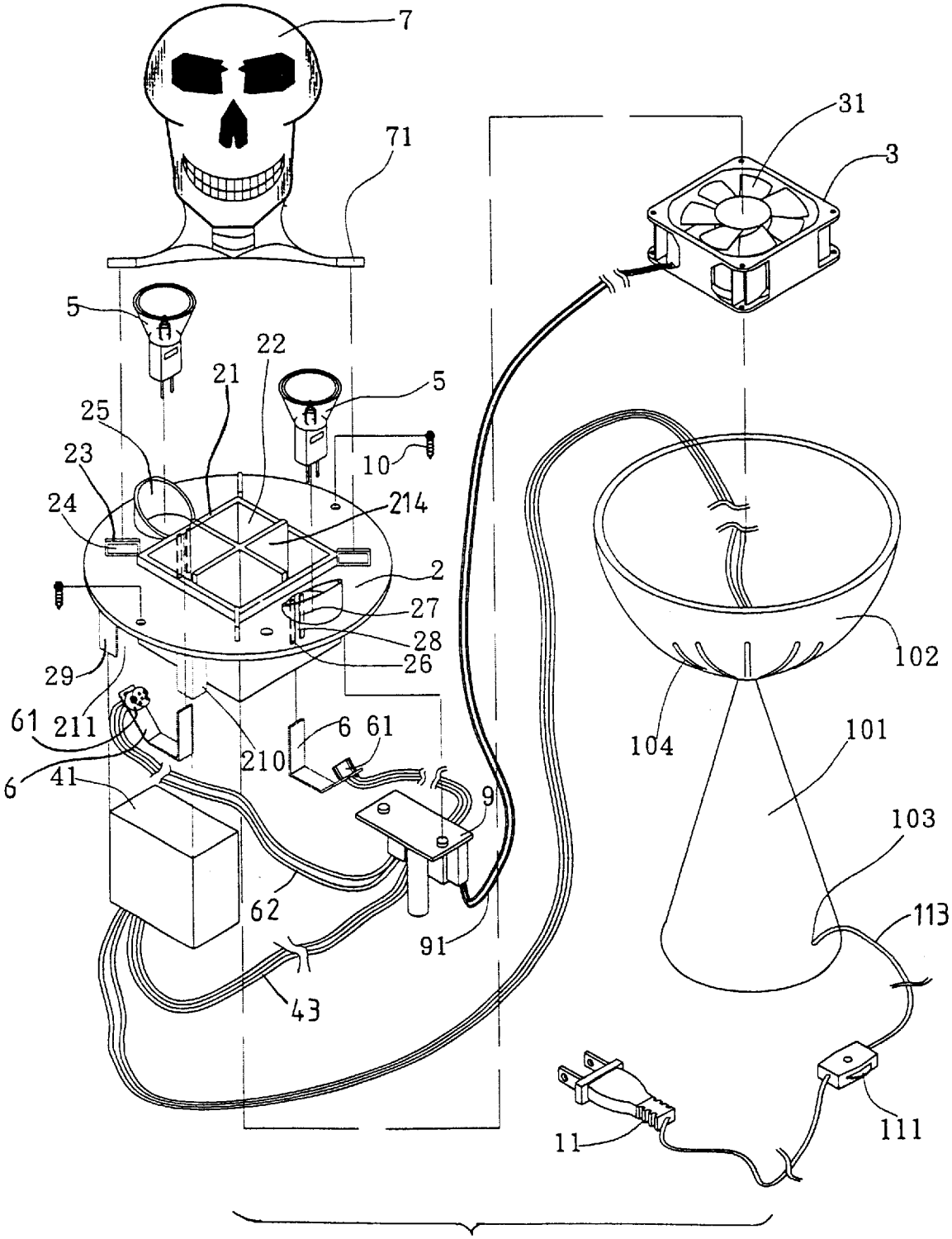
FIG. 2 is an exploded view of the lighting device.

Referring to the drawings, and initially to FIGS. 1 and 2, a lighting device in accordance with the present invention comprises a cone-shaped base 101 including a hole 103 formed therein for threading an electric wire 113 or the like, and including a receptacle, such as a bowl-shaped receptacle 102 disposed or provided on top thereof for supporting the other elements or parts. The receptacle 102 includes one or more orifices 104 formed in the bottom peripheral portion thereof for air circulation purposes or for heat dissipating purposes.

A cover or a plate 2 is secured on top of the receptacle 102 with such as the fasteners 10 or the like, and includes a housing 21 provided in the middle portion thereof and having one or more air passages 22 formed therein and defined by one or more partitions 214 that are secured in the housing 21. The plate 2 includes one or more panels 23 provided thereon and each having an adhesive layer or an adhesive material 24 applied thereon. A decorative member, particularly a decorative spatial member 7 includes one or more extensions 71 extended therefrom and engaged with the panels 23 of the plate 2 for securing to the plate 2 with the adhesive materials 24 and for being supported above the plate 2, particularly above the housing 21 and the air passages 22 of the housing 21. The decorative member 7 may be the skulls, the pumpkin heads 73 (FIG. 4), the flames, or the like.

Figure 3:
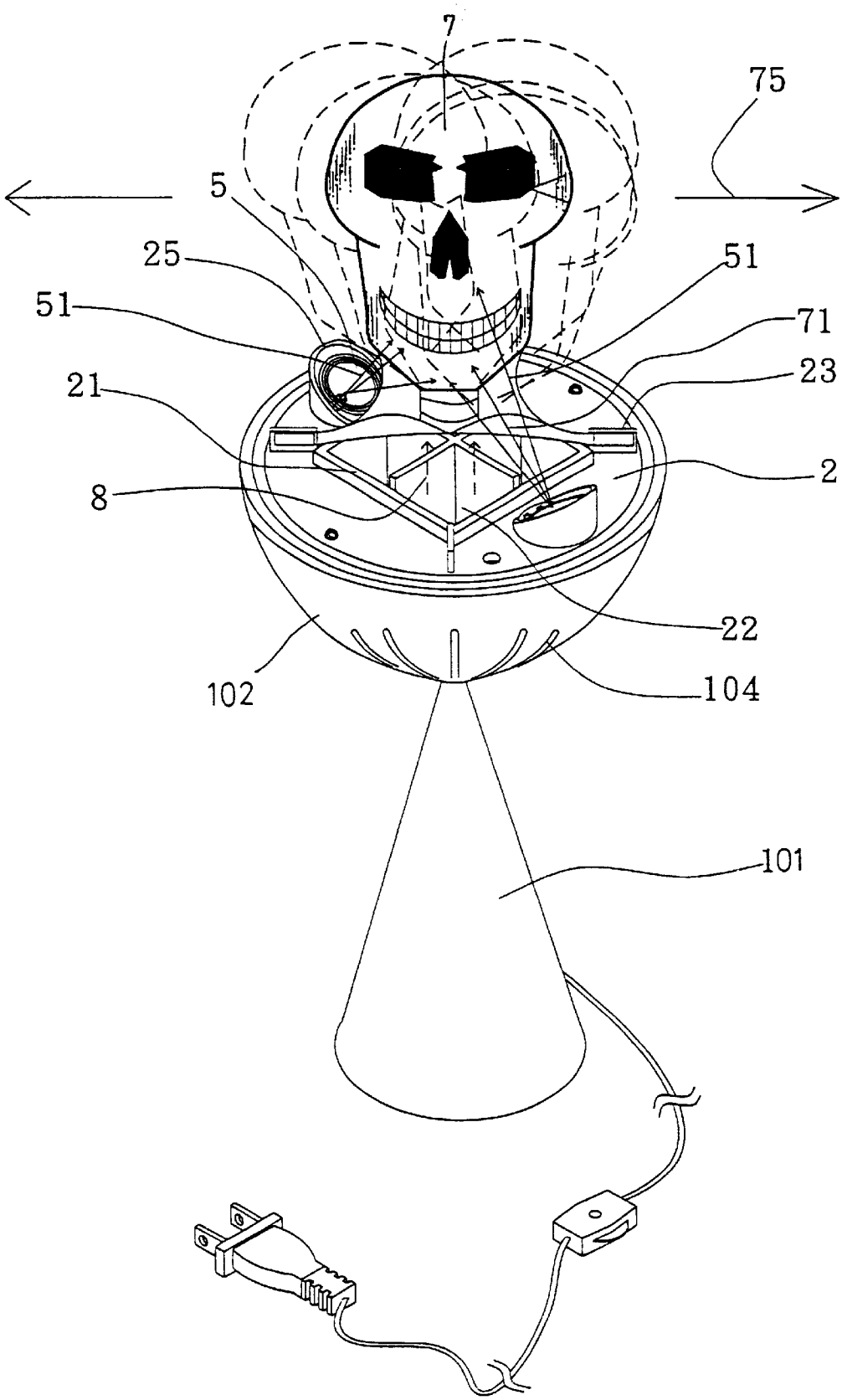
FIGS. 3 and 4 are perspective views illustrating the operation of the lighting device.
Figure 4:
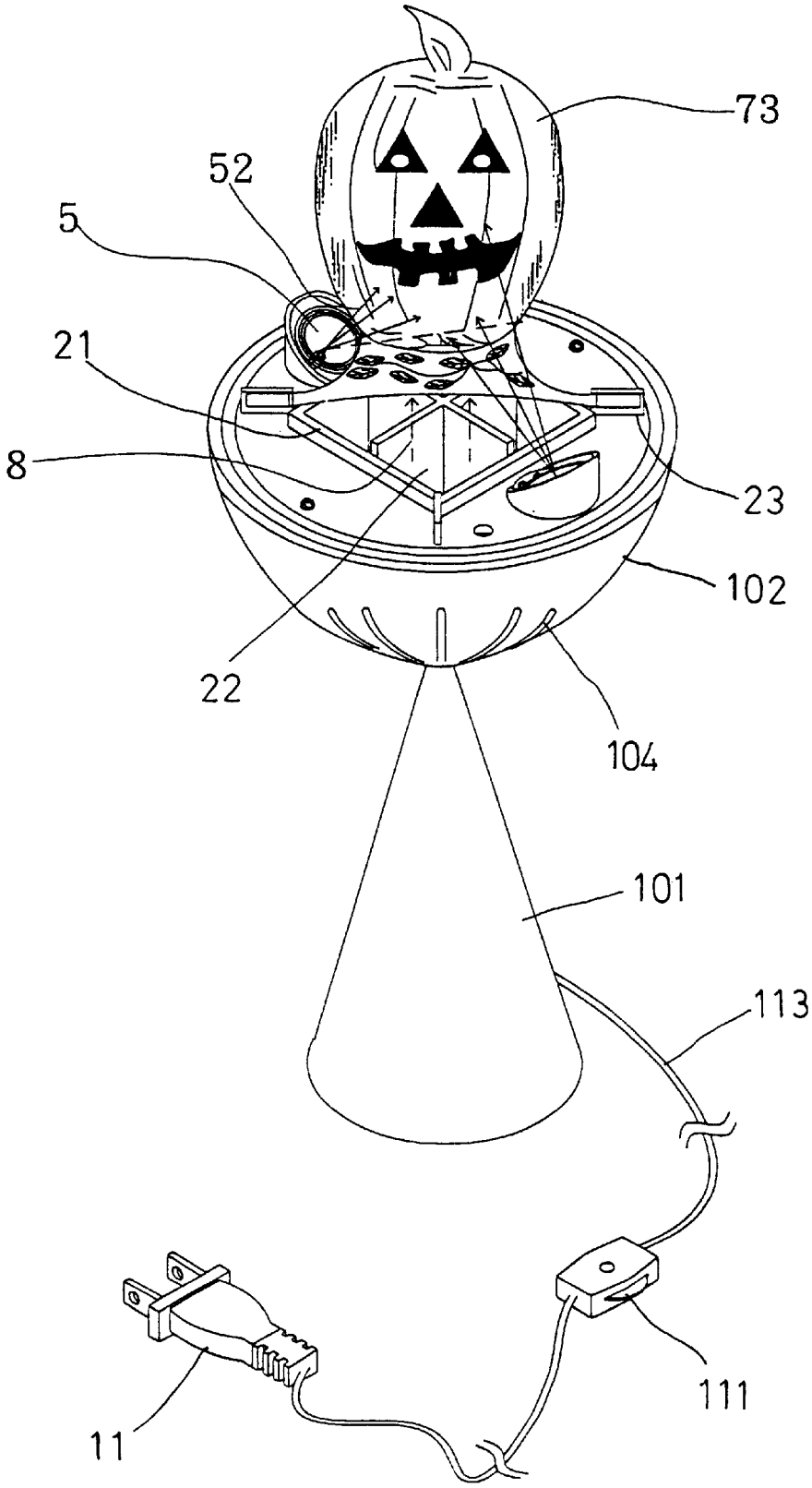

The plate 2 includes one or more lamp shades 25 provided thereon, and includes one or more pairs of engaging catches 26, 27 provided therein for forming or defining one or more locking channels 28 therein and aligned with the lamp shades 25 respectively. One or more brackets 6 each includes one end secured to the locking channels 28 of the plate 2 respectively, and each includes a socket 61 attached thereto. One or more light devices, such as the halogen light bulbs 5 are received in the lamp shades 25 and plugged to the sockets 61 and directed toward the decorative member 7 for lighting the decorative member 7. As shown in FIG. 3, when the decorative member 7 is a skull member, the light device 5 may generate a blue light 51, for example, for increasing the decorative effect. As shown in FIG. 4, when the decorative member 7 is a pumpkin head 73, the light device 5 may generate an orange light 52, for example.

The sockets 61 are coupled to an electric circuit board 9 with electric wires or cables 62. The electric circuit board 9 may be secured to the bottom of the plate 2 with the fasteners 10 or the like, and is coupled to a transformer 41 with electric wires or cables 43. A plug 11 is coupled to the transformer 41 with the electric wire or cable 113 via a switch 111 or the like. The switch 111 may thus be used to control the on and off and the lightness of the lamps or light devices 5. The plate includes one or more legs 29, 210 (FIG. 2) extended downward therefrom for forming or defining a chamber 211 therein and for receiving and securing the transformer 41 therein.

A fan device 3 is secured to the bottom of the plate 2, particularly secured to the bottom of the housing 21 with fasteners or the like, and includes a fan member 31 electrically coupled to the electric circuit board 9 with an electric wire or cable 91 and for allowing the fan member 31 to be actuated. The fan device 3 may also be actuated or controlled by the switch 111, for example. The fan member 31 of the fan device 3, when energized, may generate an air stream 8 (FIGS. 3, 4) to flow through the air passages 22 of the housing 21 and to fluctuate (75, FIG. 3) the decorative member 7, in order to generate another decorative effect.

In operation, as shown in FIG. 3, the decorative member 7, such as the skull member (FIG. 3) or the pumpkin head 73 (FIG. 4), may be blown or oscillated or fluctuated by the air streams 8 generated by the fan device 3, and/or may be lighted by the light devices 5, in order to generate the festival decorative effects.

Accordingly, the lighting device in accordance with the present invention may be used for generating specialized lighting effects and for festival decorative purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lighting device comprising:

a) a base;

b) a bowl-shaped receptacle disposed on top of said base, said receptacle including a peripheral portion having a plurality of orifices provided therein for heat dissipating purposes;

c) a plate disposed on top of said receptacle, said plate including a housing having at least one air passage formed therein, said housing including at least one partition secured therein for forming said at least one air passage therein, said plate including a locking channel formed therein and including at least one lamp shade provided thereon;

d) a decorative member disposed on said plate;

e) a fan device attached to said housing for generating an air stream to flow through said air passage of said housing and to flow toward said decorative member;

f) a bracket including a first end attached to said locking channel of said plate and including a second end;

g) a socket attached to said second end of said bracket; and h) at least one light device engaged with said socket and supported in said at least one lamp shade of said plate and directed toward said decorative member for lighting said decorative member.

* * * * *